US005492256A

United States Patent [19]

Ive

[11] Patent Number: 5,492,256

[45] Date of Patent: Feb. 20, 1996

[54] INFANT HIP CARRIER WITH STORAGE CAPABILITY

[76] Inventor: Ronald A. Ive, 12848 W. Ellsworth Pl., Lakewood, Colo. 80228

[21] Appl. No.: 387,135

[22] Filed: Feb. 1, 1995

[51] Int. Cl.[6] ..... A61G 1/00; A45F 5/00

[52] U.S. Cl. ..... 224/159; 224/208; 224/224; 224/231; 220/528

[58] Field of Search ..... 224/224, 231, 224/240, 157, 158, 159, 160, 161, 226, 202, 204, 920, 264, 208, 210, 270, 908, 240; 220/528, 555; 150/130; 190/127; 297/4

[56] References Cited

U.S. PATENT DOCUMENTS

| | | | |
|---|---|---|---|
| 3,910,470 | 10/1975 | Swenson et al. | 224/208 |
| 4,068,786 | 1/1978 | Taniguchi | 224/159 |
| 4,119,248 | 10/1978 | Butler et al. | 224/202 |
| 4,901,898 | 2/1990 | Colombo et al. . | |
| 4,905,857 | 3/1990 | Her | 224/224 |
| 5,172,838 | 12/1992 | Rowell et al. | 224/240 |
| 5,224,637 | 7/1993 | Colombo . | |
| 5,292,042 | 3/1994 | Yamaguchi et al. | 224/159 |

FOREIGN PATENT DOCUMENTS

| | | | |
|---|---|---|---|
| 384530 | 12/1932 | United Kingdom | 224/202 |

*Primary Examiner*—Henry J. Recla
*Assistant Examiner*—Gregory M. Vidovich
*Attorney, Agent, or Firm*—Timothy J. Martin; Michael R. Henson

[57] ABSTRACT

A carrier device is supported on the hip of a wearer in order to hold and carry an infant or toddler. The carrier device has a wide belt that encircles and adjustably fits on the waist o the wearer, and the belt has a pouch adjacent one hip of the wearer. A hollow shell including a shell body and a removable lid is received in the pouch to form a platform on which the child sits and to provide a storage space for auxiliary care products or other items. The shell has curved side walls which diverge upwardly and outwardly from a crescent-shaped bottom wall at small obtuse angles. Reinforcing webs support a central portion of the lid which is crescent-shaped and a rib and registration tabs are provided to seat the lid on the shell body. The lid is centrally creased to have upwardly and outwardly flared wings. The lid is canted at a small acute angle so that, with its shape and orientation, the supported child is urged toward the wearer's torso. The pouch has a padded inner side panel, and a padded cover panel extends over the lid, and has a tongue that extends downwardly alongside an outer side panel to be secured thereto. A neck harness is also employed, and a safety strap helps secure the belt around the wearer's waist.

18 Claims, 4 Drawing Sheets

INFANT HIP CARRIER WITH STORAGE CAPABILITY

FIELD OF THE INVENTION

The present invention broadly concerns carriers adapted to be worn by an adult in order to support and carry an infant or young child. More particularly, however, the present invention concerns child carriers which are supported at the hip region of the adult so that a child may be seated thereon while being held by the adult's arms.

BACKGROUND OF THE INVENTION

Since the earliest of times, parents have found it necessary to carry infants and young children as they travelled from place to place. This is, of course, due to the fact that infants are unable to walk and that young children easily become tired and cranky during even modest excursions. While carrying the child in one's arms, "piggyback" or on one's shoulders offers a natural unassisted solution to the necessity of transporting the child, the adult carrying the child may experience concomitant tiredness or discomfort due to the awkwardness of the weight distribution. Moreover, the displaced center of mass occurring as the result of the holding of a child can damage the adult's posture and even cause injury to the muscular, skeletal and nervous systems.

Accordingly, humans early discovered that mechanical structures could facilitate the support and carriage of an infant or child, and many mechanical aids have been developed. For example, any early cultures utilized a board or other support onto which a child was strapped, and the resulting structure was then carried on the back of the adult. Alternatively, some cultures employed baskets and slings to carry infants and, sometimes toddlers. In more modern times, infants have been transported by carriages and strollers, but these devices are limited to terrains over which these wheeled devices may be rolled.

Recently, it has become popular to transport children by employing a backpack style infant carrier comprising a metal framework supporting a fabric saddle or pouch in which the infant/child sits. A pair of straps extend over the adult's shoulders, and a belt may encircle the torso of the adult to help stabilize the infant carrier. In another solution to the infant carrier, a fabric pouch is positioned in front of the adult's chest, and this pouch is supported by straps which again extend over the shoulders of the adult. Here, the child is typically seated in the pouch facing the adult so the adult can place his/her arms around the child and, likewise, the child may place his/her arms around the neck of the adult.

While these structures have proved quite adequate in transporting children and while they are particularly suitable for transporting children a substantial distance, they nonetheless have drawbacks. Primary among these drawbacks is the relative difficulty of mounting and demounting the child with respect to the carrier. In order the meet the need for temporary support of a child, especially during walking, and the need for quick mounting and demounting of the child, several types of hip carriers have been developed. One example of such a hip carrier is shown in U.S. Pat. No. 4,901,898 issued Feb. 20, 1990 to Columbo et al. In this device, a waist mounted carrier employs a saddle that is configured to match the shape of a waist of an adult human so as to be supported on one of the hips. This saddle is releaseably secured to the waist of the adult by means of a standard type belt which encircles the waist and is buckled in place. In one embodiment of the structure shown in the '898 Patent, the saddle is molded internally of a crescent-shaped foam body to cushion the hip of the adult as well as the buttocks of the child.

A further example of a hip-type carrier is shown in U.S. Pat. No. 5,224,637 issued Jul. 6, 1993 to Columbo. Here, a fabric belt incorporates an integral fabric seat portion which is adapted to receive and support an infant which is positioned to face the adult wearing the infant carrier. The integral seat portion is formed by a section of the belt and by a loop of fabric that extends away from and back to the belt section at spaced locations. Upper and lower crescent-shaped panels formed as gussets interconnect the belt section and the loop portion to form an interior. A compressible foam body or bladder of air is disposed in the interior to hold the upper and lower gussets apart as well as to hold the loop of fabric and the section of belt away from one another. Opposite ends of the belt are provided with mated hook and loop fasteners, and an auxiliary safety strap is provided. A shoulder strap may also be clipped to the outer upper edge of the seat so that the infant carrier is supported not only by the waist belt but also by the shoulder strap extending around the shoulders of the adult wearer.

Despite the advances made in the past, and despite the advantages present in the devices shown in the '898 Patent and the '637 Patent, there remains a need for improved infant carriers which are comfortable to wear and which adequately support a child while being held, especially during transport. A need especially exists for such an infant carrier that can serve the dual purpose of an infant support and a storage pouch for containing auxiliary items used in caring for the infant or otherwise desired to be carried by the adult. This is especially true since the carrying of the child on such a hip carrier makes it difficult to carry other packs or bags to contain such items.

SUMMARY OF THE INVENTION

It is an object of the present invention to provide a new and useful infant hip carrier with storage capability.

Another object of the present invention is to provide a new and improved hip carrier which provides firm yet comfortable support for a child.

A further object of the present invention is to provide an infant hip carrier that is comfortable for wear by an adult yet which can support a child who weighs up to approximately sixteen kilograms (35 lbs).

Still a further object of the present invention is to provide an infant carrier which may be mounted around the waist of an adult wearer and supported on a hip thereof in a manner that is safe and comfortable.

Yet another object of the present invention is to provide an infant carrier having a storage compartment for auxiliary items which storage compartment is easily accessible.

It is another object of the present invention to provide an infant hip carrier that safely supports an infant or child with increased comfort and reduced strain on the adult holding the child.

To accomplish these objects, the present invention provides a carrier device adapted to be worn by a person in order to support a child. Broadly, the carrier device includes a shell that has a shell body including a crescent-shaped bottom wall having a bottom peripheral edge, an arcuate inner side wall and an arcuate inner outer wall connected at opposite ends to one another and each extending upwardly from the bottom wall to terminate in an upper peripheral edge thereby to form a compartment having an interior. This shell also includes a crescent-shaped lid which is sized and adapted to engage the upper peripheral edge of the shell body and which is operative to enclose the interior of the shell and also to provide a platform for supporting the child thereon. The carrier device includes a belt which is adapted to extend around a waist region of the person and which has opposite belt end portions releasable securable to one another to fasten the belt to the waist of the adult. A pouch is disposed on the belt and has a pouched interior sized and adapted to nestably receive the shell and the lid with the interior side wall of the shell located proximately to the waist region of the person supporting the child so that the shell has a concave region facing the waist region of the person. In this manner, the carrier device is supported so that the shell and pouch rests on the hip of the person supporting the child.

Preferably, the shell includes at least one, but preferably two reinforcing webs extending between the inner and outer side walls and upwardly from the bottom wall to divide the compartment into a plurality of chambers. These webs terminate in web edges that are coextensive with the upper shell edge so that the webs are operative to support the lid at a mid-portion of the lid. Moreover, it is preferred that the inner and outer side walls of the shell be oriented at a small obtuse angle, approximately 110° to 130°, inclusively, so that the inner and outer sidewalls are upwardly divergent from one another. Moreover, the upper edge of the shell is preferably constructed so that the lid is oriented at a small acute angle of approximately 10° to 20° with respect to the bottom wall such that the bottom wall and the lid diverge in a direction away from the waist region of the person when the infant carrier is worn. The lid of the shell may include a reinforcing rib extending along a majority of the peripheral margin thereof, and this rib is adapted to register with the upper edge of the shell to seat the lid in a closing relationship with the shell. A plurality of locating tabs may be formed adjacent to the rib and disposed on the inside of the lid so that the tabs help position the lid in the closing relationship and to allow pivoting of the lid relative to the shell. A lid may be creased at a central region thereof to have a pair of upwardly and outwardly flared wing portions with the upper edge of the shell configured to seat with the flared wing portions.

The pouch of the preferred embodiment of the carrier device according to the present invention is formed of a flexible material and includes a crescent-shaped lower panel, an inner side panel, an outer side panel and a closure panel. One of the inner and outer side panels preferably is a central portion of the belt, and the inner and outer side panels are joined to lower panel to define a lower edge of the pouch and are joined to each other so as to form the pouch interior. The closure panel extends across the lid when the shell is received in the pouch and overlaps the outer side panel. Cooperative fasteners are operative to releasably secure the closure panel in a closed state to contain the shell with the pouch. These cooperative fasteners, however, are releasable to open the pouch thereby allowing access to the lid so that the lid may be opened to allow access to the shell interior. The closure panel may include padding disposed thereon to cushion the buttocks of a child placed on the infant carrier. Padding may also be provided on the inner side panel to cushion against the hip region of the adult wearer.

In the preferred embodiment of the infant carrier according to the present invention, first and second matable fasteners are included on the opposite end portions of the belt. Preferably, one of the mated fasteners is disposed at the free end of one belt portion along an outer surface and extending substantially across the width of the belt. The other of the mated fasteners extends completely across the width of the other belt portion substantially for the width thereof and extends from the pouch to the free end of the belt portion on the inner surface thereof. An auxiliary, safety strap may also be provided to affix one of the belt portions to a side of the pouch opposite the attachment of the belt portion to the pouch to secure the infant carrier should the matable fasteners on the belt portions otherwise release. A shoulder harness may also be provided and may be secured to an upper outer edge of the pouch. This shoulder harness has a loop member sized and adapted to extend around the person's neck, and the loop member may include a releasable harness buckle for quick release of the shoulder harness. A portion of the loop member adjacent the harness buckle is formed of an elastic material. Moreover, this shoulder harness includes a child support pad member disposed proximately to the pouch and a neck pad slidably received on the loop member to provide padding against the neck of the wearer.

These and other objects of the present invention will become more readily appreciated and understood from a consideration of the following detailed description of the exemplary embodiment when taken together with the accompanying drawings, in which:

DETAILED DESCRIPTION OF THE EXEMPLARY EMBODIMENT

The present invention concerns infant support carriers, and specifically hip carriers adapted to be mounted around the waist of an adult wearer in order to support an infant or toddler while standing or during transport. The present invention is especially useful in providing for easy mounting and dismounting of the child on the carrier. Moreover, the present carrier is improved by providing storage space for auxiliary items carried by the adult wearer. Broadly, the present invention includes a belt adapted to extend around the waist region of the person who is going to carry a child, a pouch disposed on the belt and a shell that rigidly supports the pouch and that provides a compartment in the interior.

Figure 1:
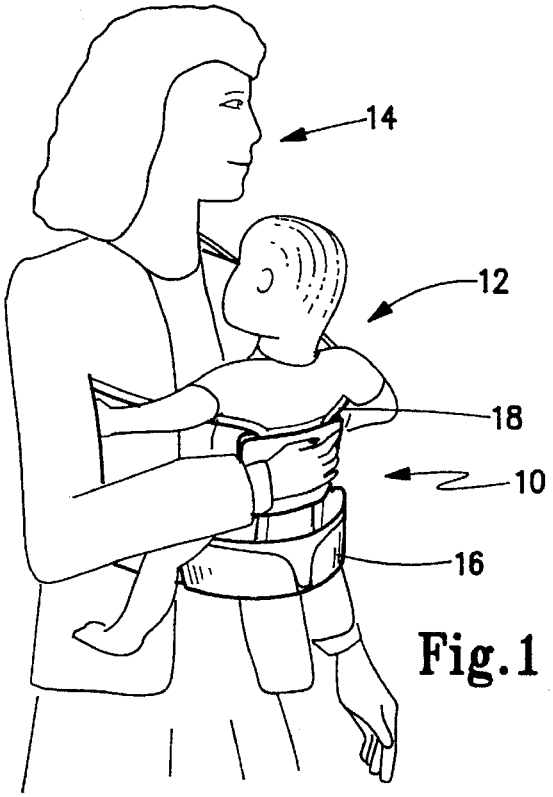
FIG. 1 is a perspective view of the infant carrier according the exemplary embodiment of the present invention with the infant carrier being worn by an adult carrier and supporting a child thereon.

Accordingly, as is shown in FIG. 1, hip carrier 10 is adapted to support a child 12 when hip carrier 10 is secured around the waist of an adult wearer 14 so that the carrier 10 is supported on the hip of the wearer 14. As is shown in this FIG. 1, hip carrier 10 includes a seat portion 16 that is shown positioned on the right hip of wearer 14 although it should be understood that seat portion 16 can just as easily be supported on the left hip of the wearer. Child 12 is seated on seat portion 16 so as to face the wearer 14, and a harness 18 supports the back of the child with the child's legs straddling the waist of wearer 14. Harness 18 extends around the neck of the wearer 14.

The structure of hip carrier 10 is shown in greater detail in FIGS. 2–10. With specific reference to FIGS. 2–4, however, it may be seen that carrier 10 includes a belt 20 adapted to extend around a waist region of a person, such as wearer 14. Belt 20 has a central belt portion 22 and a pair of opposite belt end portions 24 and 26 which terminate in free ends 25 and 27, respectively. Belt 20 has an inner surface 28 including inner surface areas 30 and 32 of belt portions 24 and 26, respectively. Similarly, belt 20 has an outer surface 34 including outer surface areas 36 and 38 of belt portions 24 and 26, respectively.

A pouch 40 is disposed on belt 20 and is adapted to receive a shell 60 as described more thoroughly below. As may be seen in FIG. 3, belt portions 24 and 26 secure pouch 40 to the waist of the wearer in a fastened state by means of a pair of cooperative hook and loop fasteners. Here, belt portion 24 includes hook elements 42 located proximately to free end 25 on outer surface area 36 of belt portion 24. Cooperating loop fasteners 44 extend along inner surface 34 of belt portion 26 and, preferably, extend from the edge of pouch 40 substantially the entire length of belt portion 26 to free end 27. Thus, belt portions 24 and 26 can encircle the waist of the wearer with pouch 40 located on the hip region, and belt 20 may be fastened into position by engaging hook fasteners 42 with loop fasteners 44 at the selected adjustable location along the length of belt portion 26.

Figure 2:
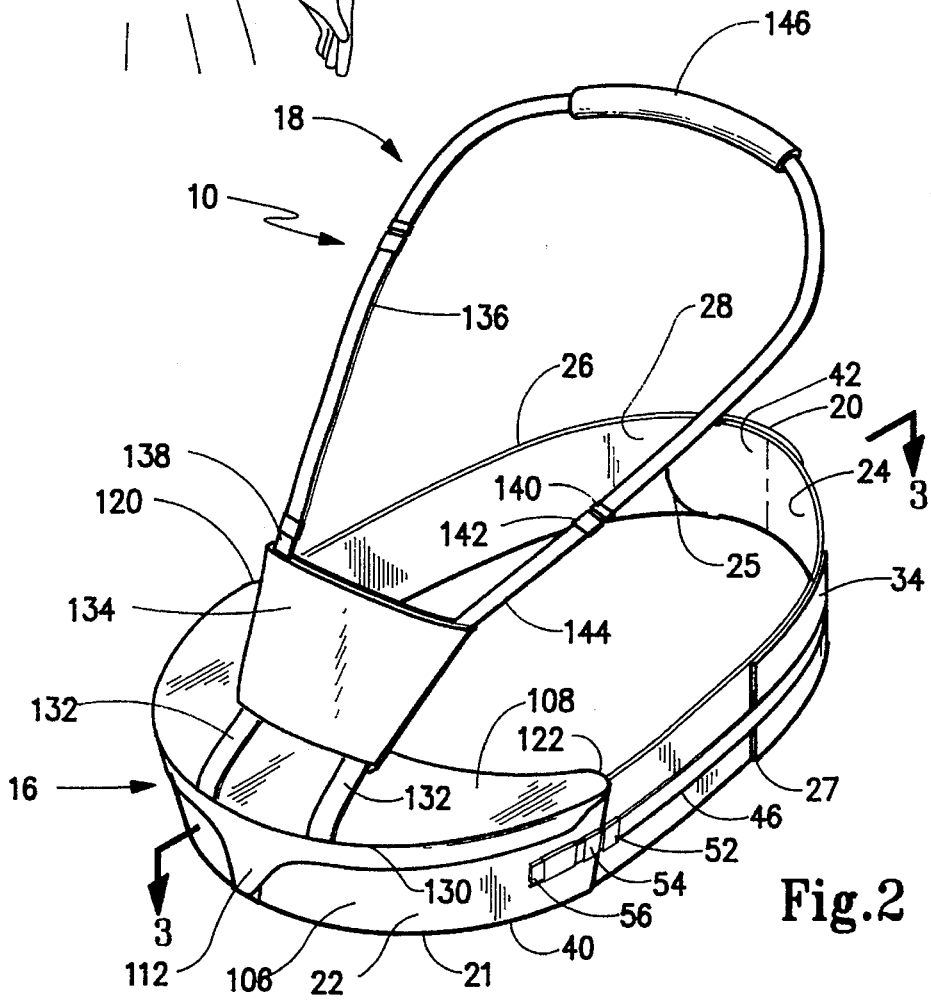
FIG. 2 is a perspective view of the infant carrier of FIG. 1.
Figure 3:
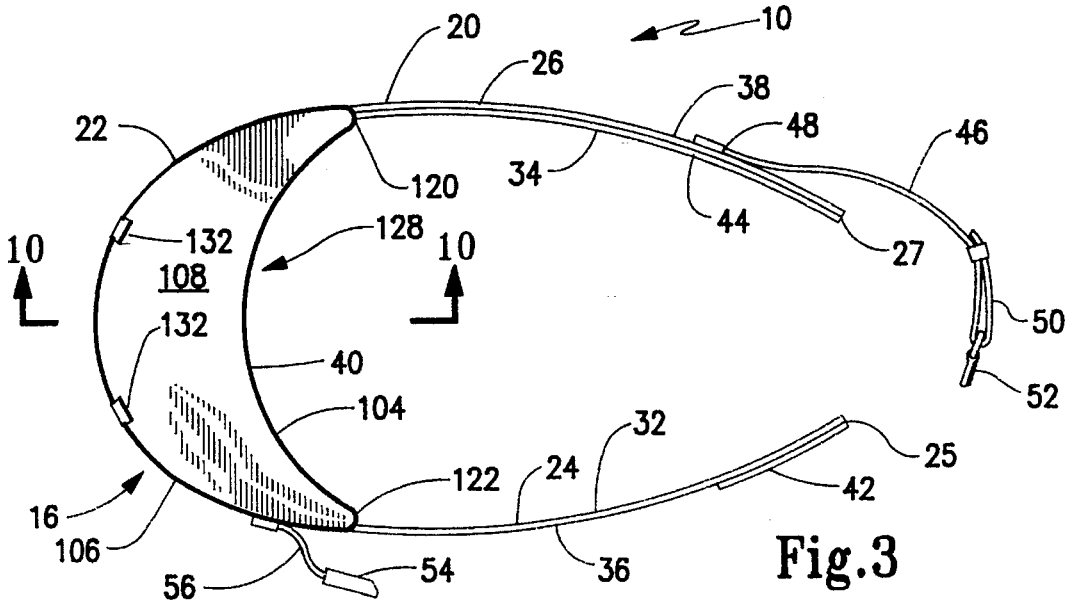
FIG. 3 is a cross-sectional view taken about lines 3—3 of FIG. 2 and showing the belt and auxiliary safety strap in a released position.

To further secure belt 20 around the waist of the wearer and to provide for safety to a child positioned on seat 16, an auxiliary, redundant safety strap 46 is provided as is shown in FIGS. 2 and 3. Safety strap 46 has a first end 48 secured to the outer surface 38 of belt portion 26 and has an end 50 opposite end 48 which is in the form of a loop that is received in a male clip fastener 52 of the quick release buckle type as is known in the art. A matable female clip fastener 54 is secured to pouch 40 at a location near the attachment of belt portion 24 to pouch 40 by means of a strip 56. Female fastener 54 is configured to releasably engage male clip fastener 52, as is shown in FIG. 2, so that, after belt portions 24 and 26 are secured together, safety strap 46 may be secured to clip 54 and adjusted around the waist of the wearer. Thus, should fasteners 42 and 44 become inadvertently disengaged, strap 46 will prevent belt 20 from becoming detached thus imperiling the child.

Figure 9:
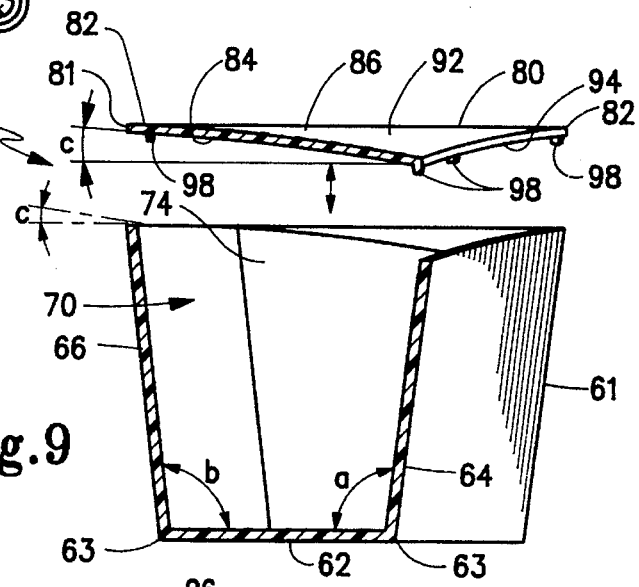
FIG. 9 is an exploded view in cross-section showing the engagement of the lid of FIGS. 7 and 8 with the shell body of FIGS. 5 and 6.

Pouch 40 is adapted to receive a shell 60 in the interior thereof. Shell 60 is best shown in FIGS. 4–6, 9 and 10. In these Figures, it may be seen that shell 60 includes a shell body 61 that has a crescent-shaped bottom wall 62 having a bottom peripheral edge 63, an arcuate inner side wall 64 and an arcuate outer side wall 66. Inner and outer side wall 64 and 66 are connected at opposite ends and each extends upwardly from bottom wall 62 to terminate in an upper peripheral edge 68 to form a compartment having interior 70 having a crescent-shaped upper opening defined by upper peripheral edge 68. As is shown in FIG. 9, inner side wall 64 is oriented at a small obtuse angle "a" relative to bottom wall 62 while outer side wall 66 is oriented at a small obtuse angle "b" with respect to bottom wall 62. Accordingly, inner and outer side walls 64 and 66 are upwardly divergent from one another with obtuse angles "a" and "b" preferably being in a range of approximately 110° to 130°.

Figure 5:
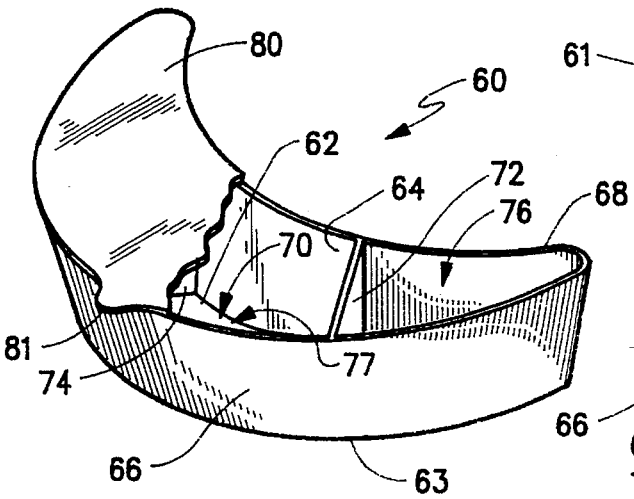
FIG. 5 is a perspective view, partially broken-away showing the shell body and lid structure used with the infant support carrier of FIGS. 1–4.
Figure 6:
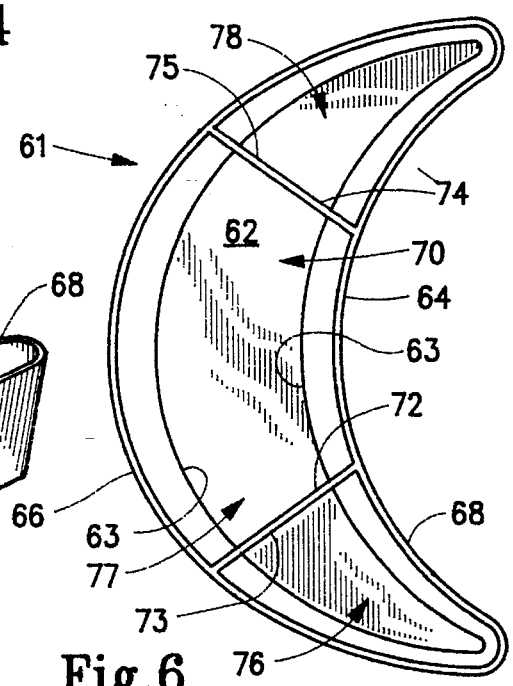
FIG. 6 is a top plan view of the shell body shown in FIG. 5 with the lid removed.
Figure 7:
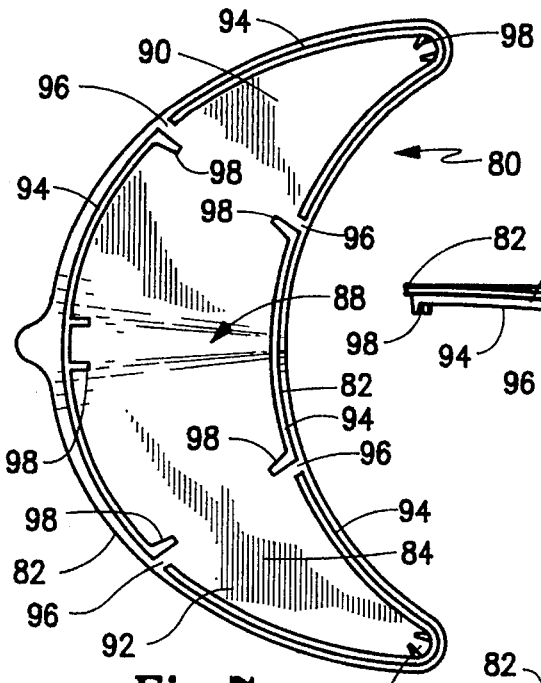
FIG. 7 is a bottom plan view of the lid used with the shell body of FIGS. 5 and 6.

Further, as is seen in FIGS. 5 and 6, a pair of reinforcing webs 72 and 74 extend between inner and outer side walls 64 and 66 of shell body 61 and extend upwardly from bottom wall 62 to divide the compartment formed by interior 70 into a plurality of chambers 76, 77 and 78. Each of webs 72 and 74 terminate in upper web edges 73 and 75, respectively, which are coextensive with the upper peripheral edge 68 of shell body 61.

Figure 8:
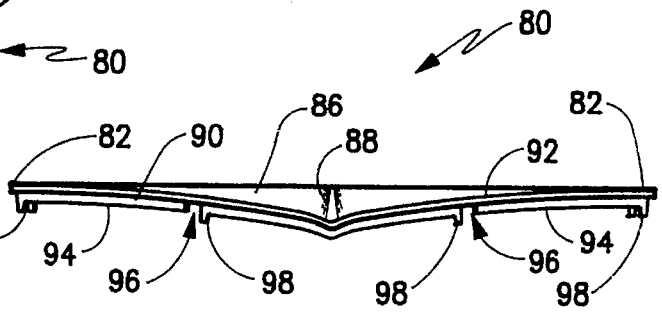
FIG. 8 is a rear view in elevation of the lid shown in FIG. 7.
Figure 10:
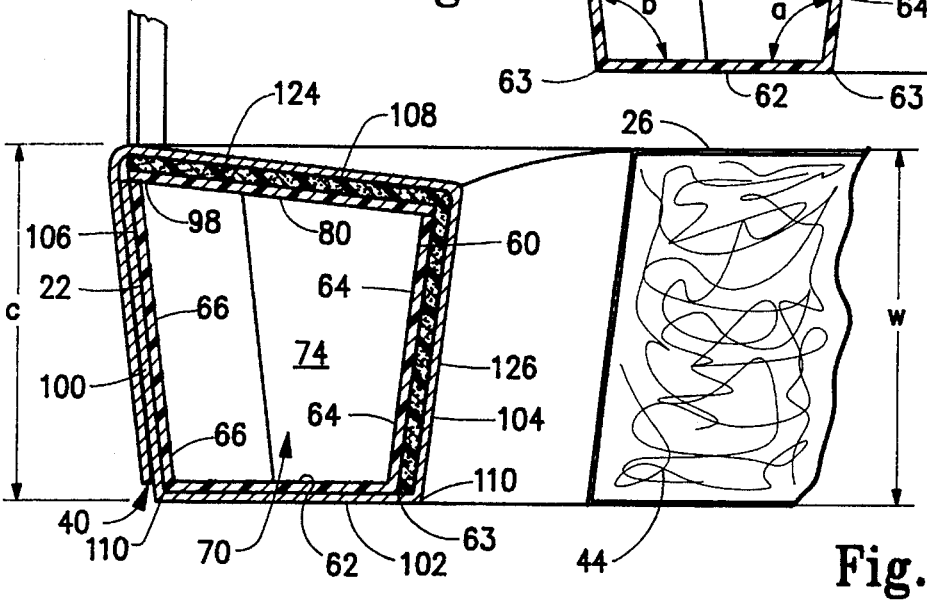
FIG. 10 is a cross-sectional view taken about lines 10—10 of FIG. 3.
Figure 11:
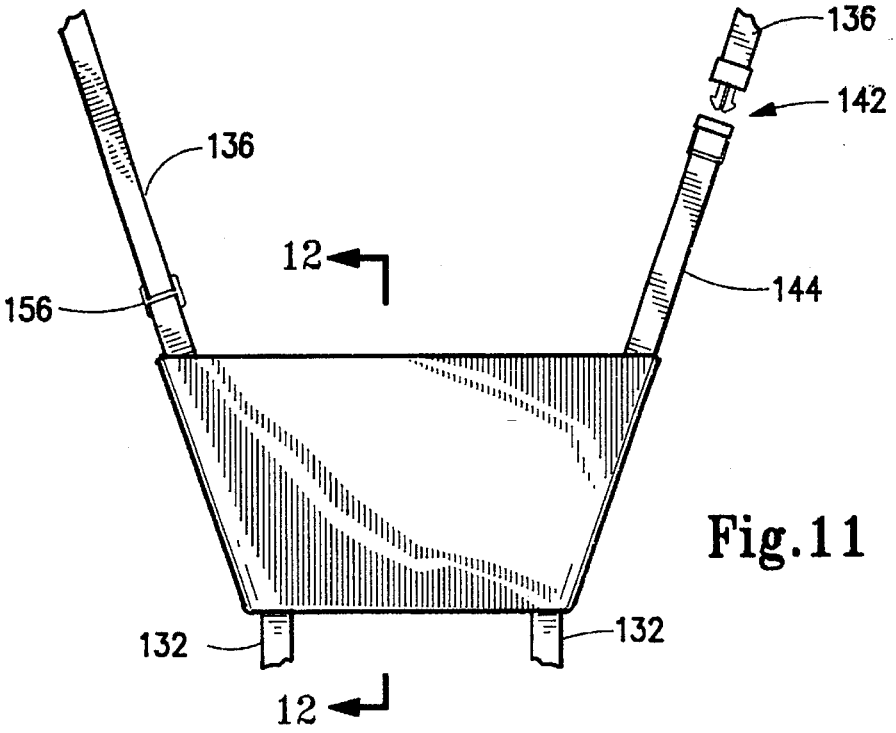
FIG. 11 is a front view in elevation, partially broken-away, showing the shoulder harness used with the infant carrier of FIGS. 1 and 2.

A crescent-shaped lid 80 is sized and adapted to engage the upper peripheral edge 68 of shell body 61 to complete the structure of shell 60. Lid 80 is operative to enclose the interior 70 of shell 60 so as to provide a platform for supporting the child 12 thereon. Web 72 and 74 thus operate to support midportions of lid 80 which has a peripheral lid edge margin 82 supported by inner and outer side wall 64 and 66 along upper peripheral edge 68. Lid 80 is best shown in FIGS. 5 and 7–9. Lid 80 has an inner surface 84 and an outer surface 86 and, as is shown in FIG. 8, is formed to have a creased central region 88 so as to have a pair of upwardly and outwardly flared wing portions 90 and 92. As is shown in FIGS. 9 and 10, it is preferred that the upper peripheral edge 68 of shell 60 be constructed so that lid 80 is oriented at a small acute angle "c" with respect to bottom wall 62 so that the bottom wall 62 and lid 80 diverge in a direction away from the waist region of the person when hip carrier 10 is worn therearound. Preferably, angle "c" is approximately 10° to 20°.

Turning again to FIGS. 7–9, it may further be seen that a rib 94 extends around a majority of the peripheral lid edge margin 82, with portions of rib 94 being separated by small gaps, such as gaps 96. Rib 94 is adapted to register with the upper peripheral edge 68 of shell body 61, preferably in interior 70, so as to seat lid 80 in a closing relationship with inner and outer side walls 64 and 66. Rib 94 is located on inner surface 84 of lid 80 and includes a plurality of locating tabs 98 adjacent to rib 94. Tabs 98 are operative to help place lid 80 in the closing relationship and to allow pivoting of lid 80 relative to the shell body 61. Thus, pivoting of lid 92 relative to shell body 61 allows access into the interior 70 of shell 60. To this end, lid 80 is provided with a small tongue 81 that may be lifted by the wearer's fingers.

Figure 4:
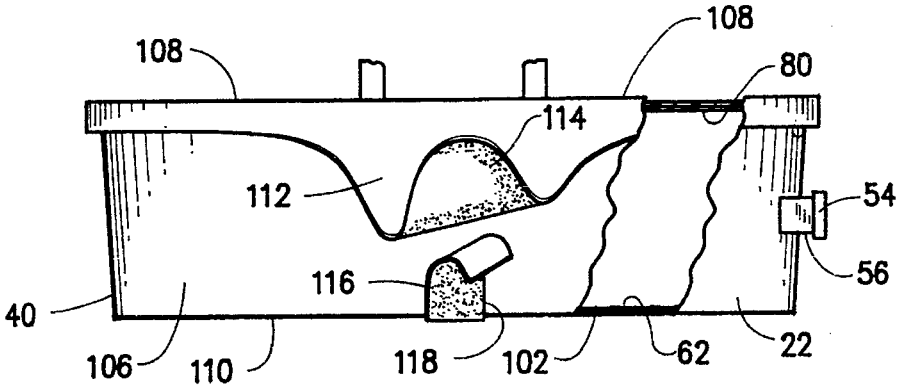
FIG. 4 is a front view in elevation and partially broken-away showing the infant carrier of FIGS. 1–3 with the closure panel in a detached condition.

As noted above, shell 60 is received in pouch 40 that is disposed on belt 20 of hip carrier 10. With reference to FIGS. 2–4 and 10, it may be seen that pouch 40 has an interior 100 that is sized and adapted to nestably receive shell 60, including shell body 61 and lid 80. Pouch 40 accordingly is formed of a flexible material, such as heavy cloth, and includes a crescent-shaped lower panel 102, an inner side panel 104, an outer side panel 106 and a crescent-shaped closure panel 108. Inner and outer side panels 104 and 106 are joined to lower panel 102 to define a lower edge 110 and are joined to each other to form pouch interior 100. Closure panel 108 extends across lid 80 when shell 60 is received in pouch 40, as is best shown in FIG. 10. Closure panel 108 includes a tongue portion 112 which overlaps outer side panel 106 to extend downwardly alongside outer panel 106, as is best shown in FIGS. 2 and 4. Closure panel 108 may be secured into position by cooperating fasteners such as loop fasteners 114 located on the inner side of tongue 112 which loop fasteners 114 releaseably secure to hook fasteners 116 on strip 118 secured to lower edge 110 exteriorly of pouch 40. Naturally, other suitable fasteners could be employed without departing from the scope of this invention. Fasteners 114, 116 cooperate with one another and are operative to secure closure panel 108 in a closed state to contain shell 60 therein but are releasable to open pouch 40 thereby allowing access to lid 80 so that lid 80 may be opened to correspondingly allow access to shell interior 70.

It should be understood from the foregoing description that it is preferred that one of inner and outer panels 104, 106 is formed as a continuous extension of belt 20 and forms the central portion 22 thereof. In the preferred embodiment, it is preferred that outer panel 106 provides central belt portion 22, as is shown in FIGS. 2, 4 and 10. Inner panel 104 is a separate piece sewn between opposite edges 120 and 122, as is shown in FIGS. 2 and 3. Bottom panel 102 is then joined to a mid-portion of the lower edge 21 of belt 20. Moreover, with reference to FIG. 10, it may be seen that suitable padding is provided both to cushion an infant seated the platform provided by lid 80 as well as to cushion the hip of the wearer 14. In FIG. 10, it may be seen that foam padding 124 is disposed on the underside of closure panel 108. Foam padding 126 is disposed on the inner side of inner panel 104 to cushion shell 60 against the hip of the wearer.

Also, from the foregoing description, it may be seen that pouch 40 and shell 60, when nested therein, forms a concave region 128 (FIG. 3), due to the crescent shape of bottom wall 62 and lid 80 along with the similarly configured panels 102 and 108 which extend therealong. Concave region 128 is positioned to face the waist region of wearer 14 and should be sized and dimensioned so as to fit the waist region of an average adult. A shoulder harness is also provided to further support pouch 40 and the shell 60 nested therein. Thus, as is shown in FIGS. 1, 2, 11 and 12, shoulder harness 18 is secured to an outer upper edge 130 of closure panel 108 by means of a pair of flexible strips 132, best in FIGS. 2 and 3. Strips 132 have first ends secured to outer upper edge 130 and second ends fastened to a pad member 134. A strap 136 has a first end 138 secured to pad member 134 and a second end 140 fastened to buckle 142 which in turn is connected to pad member 134 by means of an elastic strap 144. Thus, straps 136 and 144 define a loop member sized and adapted to extend around the wearer's neck with the child 12 being supported against falling backward by means of pad member 134.

Figure 12:
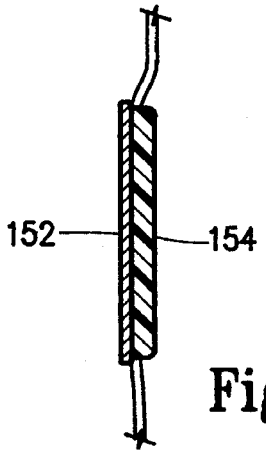
FIG. 12 is a cross-sectional view taken about lines 12—12 of FIG. 11.
Figure 13:
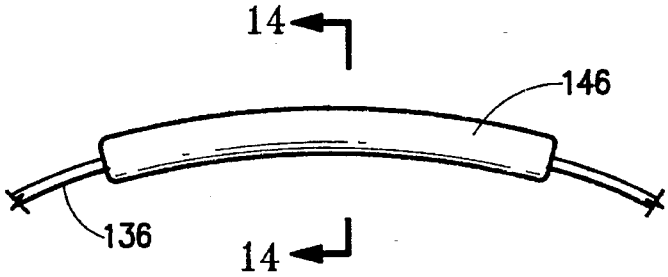
FIG. 13 is a side view in elevation of the neck support pad used with the shoulder harness of FIGS. 1, 2 and 11.
Figure 14:
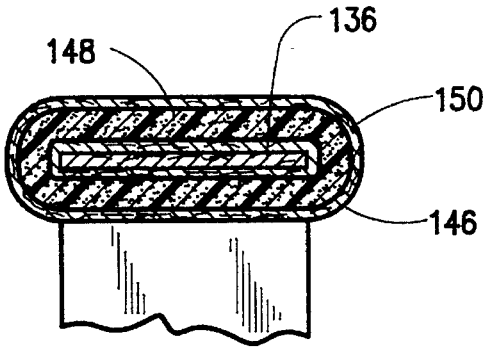
FIG. 14 is a cross-sectional view taken about lines 14—14 of FIG. 13.

Buckle 142 is a quick releasable harness buckle so as to permit easy mounting and dismounting of child 12 onto hip carrier 10, and the provision of elastic strap 144 likewise facilitates this mounting and dismounting in addition to providing some degree of freedom of movement of child 12 secured by hip carrier 10. To further cushion harness 18 with respect to the wearer, a neck pad member 146 extends around a midportion of strap 136 and is slidably received thereon. To this end, neck pad member 146 is in the form of tubular sleeve of foam material 148 which has a fabric sheath 150 extending therearound. Further, to cushion the child, pad member 134 preferably includes an outer fabric panel 152 and an inner foam padding 154 disposed thereon, as is shown in FIG. 12. With reference again to FIG. 11, it may also be seen that strap 136 is adjustable by means of adjusting element 156 along with buckle 142 which is of the standard adjusting type. This allows the effective dimension of harness 18 to be changed, depending upon the size of the child.

From the foregoing, it may be appreciated that hip carrier 10 may be mounted to a wearer by first positioning pouch 40 and the nested shell 60 so that concave region 128 engages the waist and hip of the wearer 14 on either the left or right side of the wearer's body. Belt 20 may then be fastened around the waist wearer 14 by extending belt portions 24 and 26 snugly around the waist and securing them by engaging hook and loop fasteners 42, 44. To this end, and with reference to FIG. 10, it should be appreciated that loop fasteners 44 extend substantially the entire width "w" of belt portion 26 and, likewise, hook fasteners 42 extend substantially the entire width of belt portion 24 as is shown in phantom in FIG. 2. After fastening hook and loop fasteners 42, 44 into the adjusted position snugly about the waist of wearer 14, safety strap 46 is fastened by engaging male clip fastener 52 in female clip fastener 54 and adjusting loop end 50 so that safety strap 46 is snug.

Harness 18 is then extended under one arm and over the neck and other shoulder of wearer 14 (as shown in FIG. 1) and the effective length may be adjusted by means of adjusting element 156 and buckle 142. Buckle 142 may then be released and a child 12 placed on the platform defined by pouch 40 and shell 60 nested therein with harness 18 positioned under both arms of child 12. To this end, it should be appreciated that shell 60 is formed of a strong, stiff material, such as plastic, which is suitable to hold the weight of child 12, and with the above construction it has been found that children weighing up to about 16 Kg (35 lbs.) can comfortably be carried. Due to the angle "c", child 12 is urged towards the torso of wearer 12, and harness 18 may now be fastened about child 12 by reengaging buckle 142.

Notwithstanding the positioning of child 12 on hip carrier 10, the wearer 14 may, if desired, still gain access to the interior 70 of shell 60 by releasing tongue portion 112 by disengaging fasteners 114, 116; however, this procedure is not recommended and it is preferred that the child be dismounted from the carrier when accessing the interior 70. Due to the connection of harness 18 to the outer upper edge 130 of closure panel 108, child 12 is still supported as pouch 40 is opened and lid 80 is pivoted upwardly by lifting tongue 81 to allow access to the interior 70 and particularly to chamber 76-78 of the compartment formed by shell 60. These chambers 76-78 may contain auxiliary care products such as baby wipes, diapers, talcum powder, etc. or, if desired, beverages for either the adult wearer or the child.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. A carrier device adapted to be worn by a person in order to support a child, comprising:

(a) a shell including a shell body having a crescent-shaped bottom wall having a bottom peripheral edge, an arcuate inner sidewall and an arcuate outer sidewall connected at opposite ends thereof and each extending upwardly from said bottom wall to terminate in an upper peripheral edge thereby to form a compartment having an interior, said shell including a crescent-shaped lid sized and adapted to engage the upper peripheral edge of said shell and operative to enclose the interior of said shell body said shell body and said lid being sized to provide a platform for supporting the child thereon;

(b) a belt adapted to extend around a waist region of the person and having opposite belt end portions releasably securable to one another; and (c) a pouch disposed on said belt and having a pouch interior sized and adapted to nestably receive said shell body and said lid with said inner sidewall being located proximately to the waist region of said person when said belt is extended around the waist region of said person so that said shell has a concave region facing the waist region of the person.

2. A carrier device according to claim 1 wherein said shell includes a re-enforcing web extending between said inner and outer sidewalls and upwardly from said bottom wall thereby to divide the compartment into a plurality of chambers.

3. A carrier device according to claim 2 wherein said web terminates in a web edge co-extensive with the upper shell edge whereby said web is operative to support said lid at a mid-portion thereof.

4. A carrier device according to claim 1 wherein said inner and outer sidewalls are each oriented at a small obtuse angle with respect to said bottom wall with said inner and outer sidewalls being upwardly divergent from one another.

5. A carrier device according to claim 4 wherein the small obtuse angle is between 110° and 130°, inclusively.

6. A carrier device according to claim 1 wherein the upper edge of said shell is constructed so that said lid is oriented at a small acute angle with respect to said bottom wall such that said bottom wall and said lid diverge in a direction away from the waist region of said person.

7. A carrier device according to claim 1 wherein said lid has a rib extending a majority therearound, said rib adapted to register with the upper edge of said shell thereby to seat said lid in a closing relationship with said inner and outer side walls.

8. A carrier device according to claim 7 wherein said lid has a plurality of locating tabs adjacent to said rib, said tabs operative to help position said lid in the closing relationship and to allow pivoting of said lid relative to said shell.

9. A carrier device according to claim 1 wherein said lid is creased at a central region thereof thereby to have a pair of upwardly and outwardly flared wing portions, said upper edge configured to seat against said wing portions.

10. A carrier device according to claim 1 wherein said pouch is formed of a flexible material and includes a crescent-shaped lower panel, an inner side panel, an outer side panel and a closure panel, said inner and outer side panels joined to said lower panel to define a lower edge of said pouch and joined to each other so as to form the pouch interior, said closure panel extending across said lid when said shell is received in said pouch and overlapping said outer side panel and including cooperative fasteners operative to releasably secure said closure panel in a closed state to contain said shell therein but releasable to open said pouch thereby allowing access to said lid whereby said lid is adapted to be opened thereby to allow access to the shell interior.

11. A carrier device according to claim 10 wherein said closure panel includes first padding disposed thereon.

12. A carrier device according to claim 11 including second padding disposed on said inner side panel.

13. A carrier device according to claim 1 including a safety strap having a first safety strap end secured to one of said pouch and a first belt end portion and a second safety strap end secured to a second belt end portion, said safety strap having a buckle member operative to selectively secure and release said safety strap to respectively prevent and allow release of said belt end portions from one another.

14. A carrier device according to claim 1 including a shoulder harness secured to an upper outer edge of said pouch and having a loop member sized and adapted to extend around the person's neck.

15. A carrier device according to claim 14 wherein said loop member includes a releasable harness buckle.

16. A carrier device according to claim 14 wherein a portion of said loop member adjacent said harness buckle is formed of an elastic material.

17. A carrier device according to claim 14 wherein said shoulder harness includes a child support pad member disposed proximately to said pouch.

18. A carrier device according to claim 14 including a neck pad member slideably received on said loop member.

* * * * *